US005247955A

United States Patent [19]

Wu

[11] Patent Number: 5,247,955

[45] Date of Patent: Sep. 28, 1993

[54] ERGONOMICALLY OPERATING AUTOMATIC UMBRELLA

[76] Inventor: Woh-Wen Wu, P.O. Box 55-1670, Taipei, Taiwan

[21] Appl. No.: 930,375

[22] Filed: Aug. 17, 1992

[51] Int. Cl.[5] ..... A45B 25/14

[52] U.S. Cl. ..... 135/22; 135/24; 135/25.1; 135/40

[58] Field of Search ..... 135/22, 24, 25.1, 25.41, 135/20.3, 37, 38, 39, 40, 44

[56] References Cited

U.S. PATENT DOCUMENTS

| | | | |
|---|---|---|---|
| 3,074,419 | 1/1963 | Foltis et al. | 135/22 |
| 3,746,025 | 7/1973 | Murata | 135/22 |
| 3,856,030 | 12/1974 | Sato | 135/24 X |
| 4,421,133 | 12/1983 | Huang . | |
| 4,534,374 | 8/1985 | Day . | |
| 4,823,821 | 4/1989 | Day . | |
| 4,825,888 | 5/1989 | Su . | |
| 5,088,512 | 2/1992 | Chou et al. | 135/24 |
| 5,125,426 | 6/1992 | Wu et al. | 135/44 X |
| 5,144,969 | 9/1992 | Chou et al. | 135/22 |

FOREIGN PATENT DOCUMENTS

| | | | |
|---|---|---|---|
| 511907 | 1/1954 | Belgium | 135/24 |
| 1224454 | 9/1966 | Fed. Rep. of Germany | 135/24 |

*Primary Examiner*—Carl D. Friedman
*Assistant Examiner*—Lan M. Mai

[57] ABSTRACT

An automatic umbrella includes a resetting device slidably held on a grip of the umbrella which can be grasped by a user's hand for resetting or compressing a tensioning spring provided in a central shaft of the umbrella for automatically closing the umbrella so that a resetting operation for storing an elastic energy of the tensioning spring can be operated ergonomically.

7 Claims, 9 Drawing Sheets

ERGONOMICALLY OPERATING AUTOMATIC UMBRELLA

BACKGROUND OF THE INVENTION

A conventional automatic umbrella such as U.S. Pat. No. 4,421,133 discloses by Yueh Huang can be automatically openable and closable. However, in resetting a closed or folded umbrella by depressing the handle (8) to store the elastic energy of a restoring spring, ready for its next opening operation, a depression force supplied from the umbrella user may be splitted into fraction of force acting on the pushing handle portion (8) generally hook shaped. It means that partial force from the umbrella user or operator will become waste and useless in resetting an umbrella. Therefore, a greater force is required for resetting or compressing the tensioning spring provided in the conventional automatic umbrella, which may not be openable by a child or a woman.

Other conventional automatic umbrellas such as the Su U.S. Pat. No. 4,825,888, Day No.4,823,821, Day No. 4,534,374 and Sato No. 3,856,030, each patent disclosed a straight type handle which can be depressed for resetting the restoring spring provided in the central tube or shaft of the umbrella. However, the downward restraction depression on the straight handle by a user's hand may cause an injury of the user's hand as stuck by rib tips formed on each umbrella rib.

The present inventor has found the drawbacks of the conventional automatic umbrella, and invented the present automatic umbrella which can be operated ergonomically.

SUMMARY OF THE INVENTION

The object of the present invention is to provide an automatic umbrella having a resetting device slidably held on a grip of the umbrella which can be grasped by a user's hand for resetting or compressing a tensioning spring provided in a central shaft of the umbrella for automatically closing the umbrella so that a resetting operation for storing an elastic energy of the tensioning spring can be operated ergonomically.

DETAILED DESCRIPTION

Figure 1:
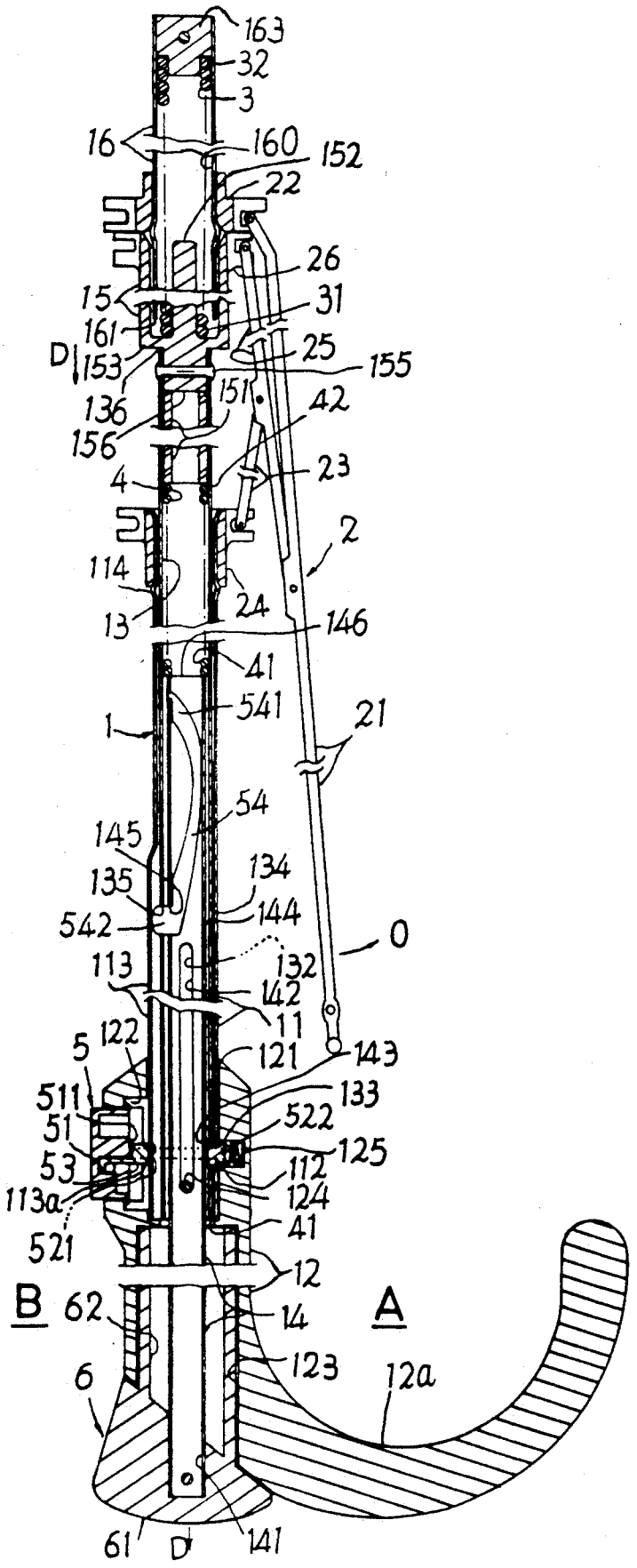
FIG. 1 is an illustration showing a folded umbrella after resetting a spring in the central shaft of the present invention.

As shown in FIGS. 1-6, the present invention comprises: a central shaft means 1, a rib means 2 for securing an umbrella cloth thereon, an umbrella-opening spring 3, an umbrella-closing spring 4, a control means 5, and a re-setting means 6.

The central shaft means 1 includes: an outer tube 11 having a grip 12 secured on a lower portion of the outer tube 11, an inner tube 13 slidably held in the outer tube 11, a lower extending tube 14 slidably held in the inner tube 13 and in the grip 12, a middle-notch bracket 15 secured on an upper end portion of the inner tube 13, and an upper sleeve 16 resiliently held on the middle-notch bracket 15. The outer tube 11 has a lower end portion 111 insertably fixed in an upper hole 121 of the grip 12, an engaging hole 112 formed in the lower end portion 111 on a first side A of the shaft means 1, an elongate groove 113 longitudinally formed in the outer tube 11 on a second side B of the shaft means 1 having a rod hole 113*a* formed in a lower end portion of the elongate groove 113, and an upper ring portion 114 formed on an upper end portion of the outer tube 11 for securing a lower notch 24 of the rib means 2 for pivotally securing a stretcher rib 23 of the rib means 2. The grip 12 has a push-button hole 122 formed in an upper portion of the grip 12 on a second side B of the shaft means 1, a guiding-tube hole 123 longitudinally formed in a lower central portion of the grip 12 and communicating the upper hole 121 of the grip 12, and a guiding pin 124 laterally secured in an upper portion of the grip 12.

The inner tube 13 has a pair of elongate slots 132 symmetrically longitudinally formed in a lower end portion 131 of the inner tube 13 to be slidably engageable with the guiding pin 124 which is slidably engageable with lower extending tube 14, a lower engaging hole 133 formed in a lower portion of the inner tube on a first side A of the shaft means 1, an upper engaging hole 134 formed in the inner tube 13 projectively positioned above the lower engaging hole 133, a protrusion hole 135 formed in an upper portion of the inner tube 13 on the second side B of the shaft means 1 opposite to the upper engaging hole 134, and a fixing pin 155 provided in the upper end portion 136 of the inner tube 13 for securing the middle-notch bracket 15 which is secured with a middle notch 26 for pivotally securing an intermediate connecting rib 25 of the rib means 2 with a middle portion of the intermediate connecting rib 25 pivotally connecting the stretcher rib 23 by a central pin 251.

The lower extending tube 14 operatively controlled by the control means 5 has a pair of elongate slots 142 symmetrically longitudinally formed in a middle portion of the extending tube 14 to be slidably engageable with the guiding pin 124, a lower engaging hole 143 formed in a lower end portion 141 of the extending tube 14 corresponding to the lower engaging hole 133 of the inner tube 13, an upper engaging hole 144 formed in the extending tube 14 positioned above the lower engaging hole 143 of the extending tube 14 corresponding to the upper engaging hole 134 of the inner tube 13, a protrusion hole 145 formed in the extending tube 14 opposite to the upper engaging hole 144 of the extending tube 14 to be corresponding to the protrusion hole 135 of the inner tube 13, and an upper tube end 146 of the extending tube 14 retaining a lower spring end 41 of the umbrella-closing spring 4.

The middle-notch bracket 15 includes: a lower tube portion 151 inserted in an upper end portion 136 of the inner tube 13 for retaining an upper spring end 42 of the umbrella-closing umbrella 4, a central stem 152 formed in a central hole 150 in the bracket 15 for retaining a lower spring end 31 of the umbrella-opening spring 3, a plug portion 156 secured with the upper end portion 136 of the inner tube 13 by a fixing pin 155, a shoulder portion 153 formed in a middle portion of the bracket 15 operatively retainable with the lower notch 24 secured on the outer tube 11, and an upper bracket portion 154 integrally secured with the middle notch 26. The central hole 150 is slidably engageable with an upper sleeve 16 of the central shaft means.

The upper sleeve 16 includes: an upper sleeve hole 160 formed in the sleeve 16, a lower sleeve portion 161 slidably engageable with the central hole 150 of the bracket 15 and for limiting the umbrella-opening spring 3 in cooperation with the stem 152 of the bracket 15, an upper block 163 fixed in a top portion of the sleeve 16 for retaining a upper spring end 32 of the opening spring 3, and a middle ring portion 162 for securing an upper notch 22 on the middle ring porion 162 for pivotally securing a top rib 21 of the rib means 2 with the top rib 21 pivotally securing an intermediate connecting rib 25 of the rib means 2.

The control means includes: push button 51 slidably held in the button hole 122 of the grip 12 having a inside button surface 511 normally urged by a pair of bifurcated arm members 521 of a locking latch 52 slidably held in an upper portion of the grip 12, a pushing rod 53 with its base portion 531 resiliently secured in a rod hole 512 formed in the inside button surface 511 of the push button 51, and a pair of tapered hook portion 513 disposed on two opposite side portions of the push button 51 to be snap retained in the button hole 12 of the grip 12; the locking latch 52 having the pair of bifurcated arm members 521 slidably disposing about the outer tube 11, an engaging wedge portion 522 formed on an end portion of a latch stem 523 resiliently retained in a spring hole 125 formed in the grip 12 on a first side A of the shaft means with the wedge portion 522 secured with a converging end portion of the two bifurcate arm members 521 adjacent to the latch stem 523, and a latch spring 524 retained in the spring hole 125 normally urging the bifurcated arm members 521 and urging the wedge portion 522 laterally towards the second side B of the shaft means 1 for selectively engaging the wedge portion 522 with the lower engaging hole 133 of the inner tube 13 when closing the umbrella and engaging the upper engaging hole 134 of the inner tube 13 when opening the umbrella; and a resilient coupler 54 having an upper coupler end 541 secured in the lower extending tube 14 and a lower protrusion 542 respectively engageable with a protrusion hole 145 formed in the extending tube 14 and with a protrusion hole 135 formed in the inner tube 13 for coupling the lower extending tube 14 and the inner tube 13 for retaining the umbrella-closing spring 4 when compressed, the lower protrusion 542 slidably held in the elongate groove 113 of the outer tube; whereby upon a depression of the push button 51 to disengage the wedge portion 522 from the lower engaging hole 133 of the inner tube 13, th umbrella-opening spring 3 will urge the middle-notch bracket 15, the inner tube 13, the lower extending tube 14 and the resetting mean 6 downwardly along the grip 12 for opening the umbrella; and upon a further depression of the push button to depress the lower protrusion 542 of the resilient coupler 54 to disengage the lower extending tube 14 from the inner tube 13, the umbrella-closing spring 4 will urge the inner tube and the middle notch upwardly for closing the umbrella; and upon a depression of the resetting means upwardly along the grip, the umbrella-closing spring will be compressed for resetting its elastic energy.

The detailed operation sequences of the present invention will be further described hereinafter.

The resetting means includes: a depression portion 61 secured on a lower end portion 141 of the lower extending tube 14 and a guiding tube 62 secured with the depression portion 61 and disposed around the lower extending tube 14 with a tubular hole in the guiding tube 62, the guiding tube 62 being slidably engageable with a guiding-tube hole 123 in the grip 12.

Figure 7:
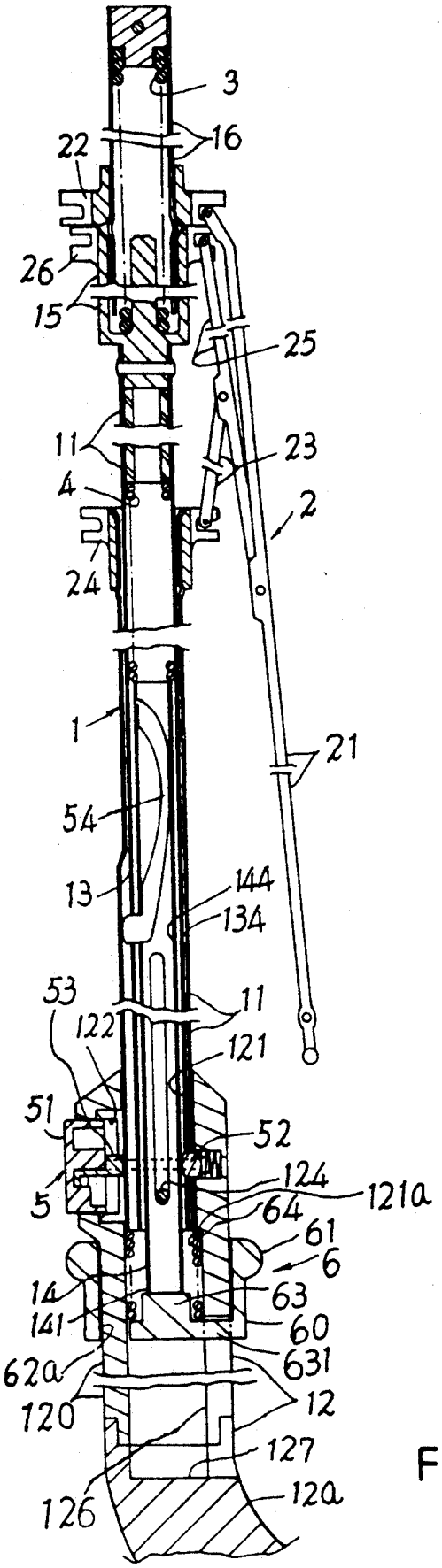
FIG. 7 shows a folded umbrella of another preferred embodiment of the present invention.
Figure 8:
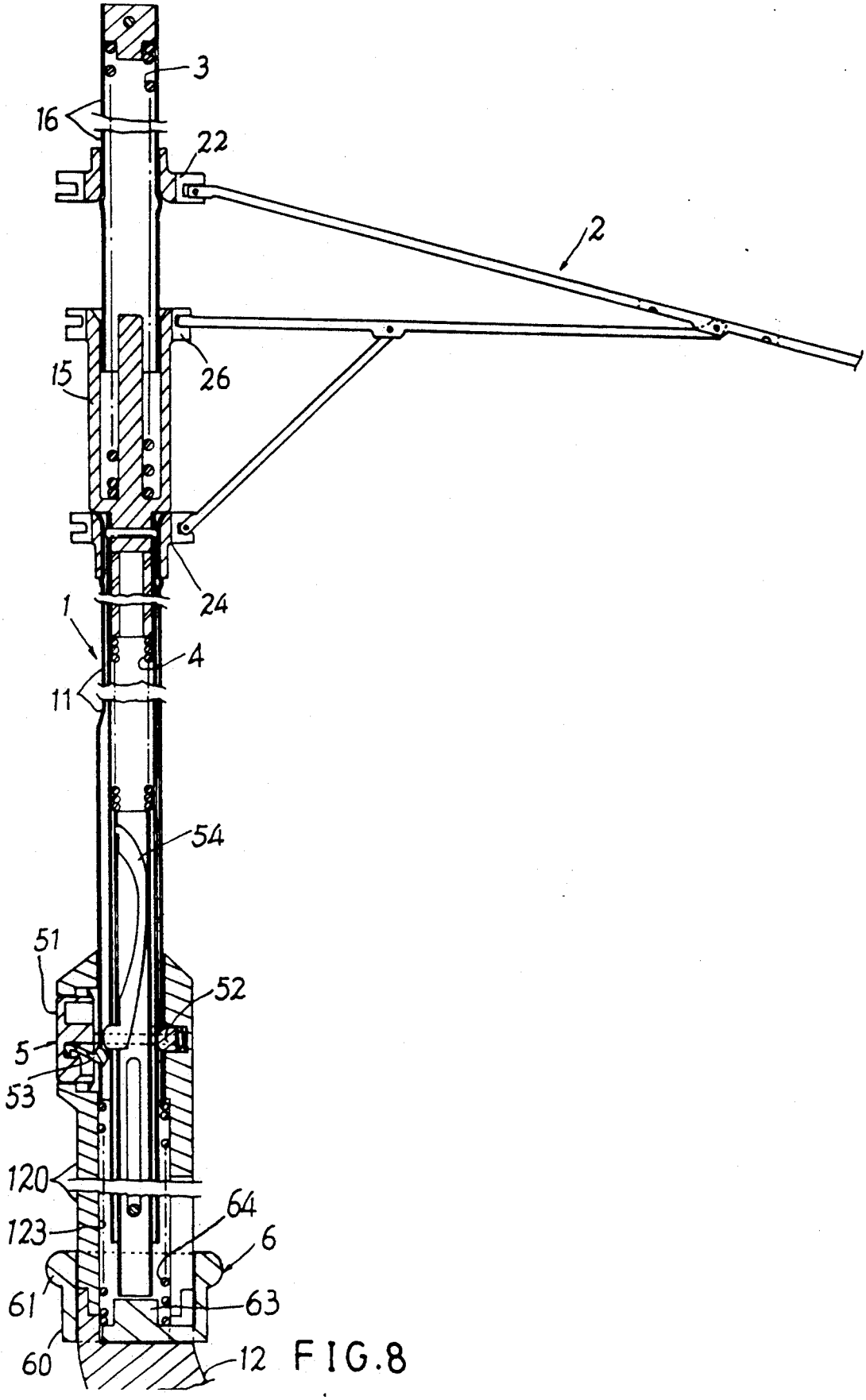
FIG. 8 shows an opened umbrella from FIG. 7.
Figure 9:
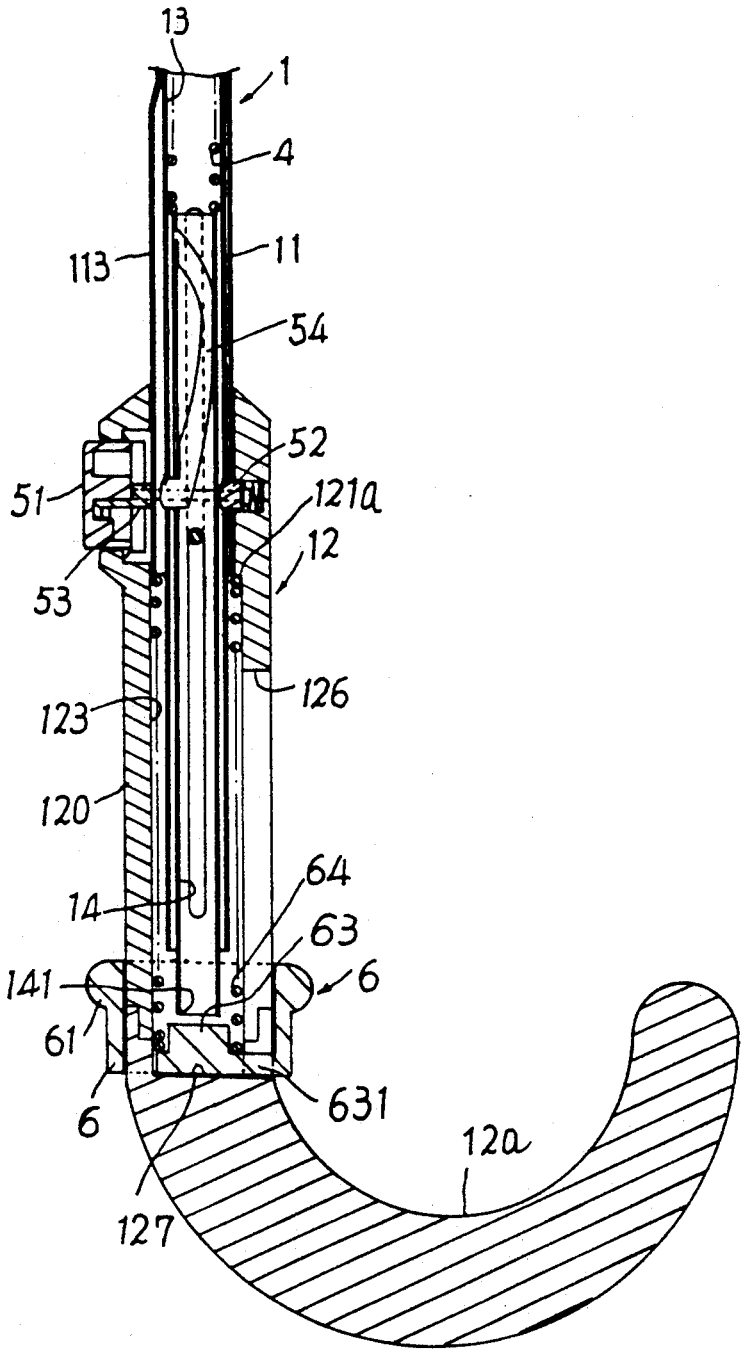
FIG. 9 shows a control means ready for closing the umbrella from FIG. 7.
Figure 10:
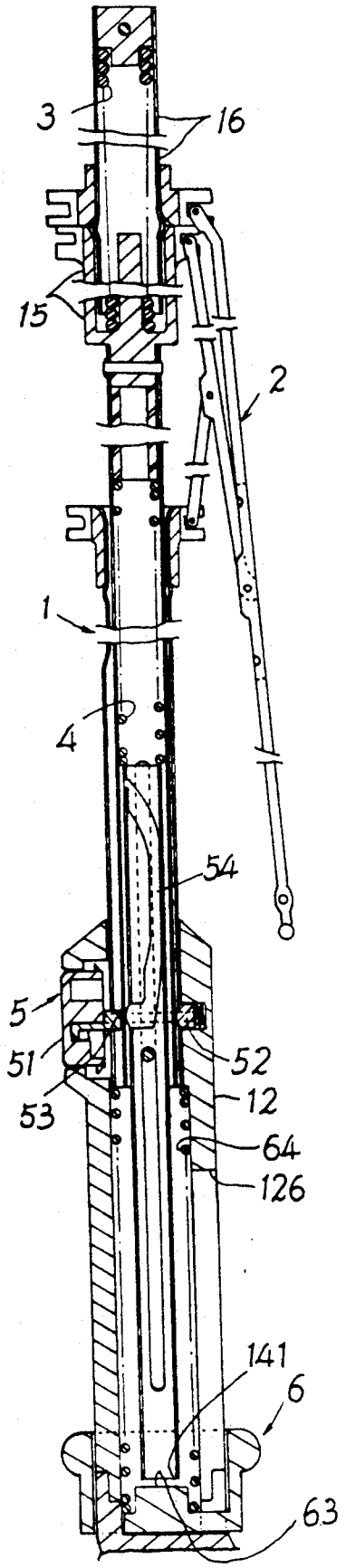
FIG. 10 shows a closed umbrella not yet resetting the spring in the central shaft means.
Figure 11:
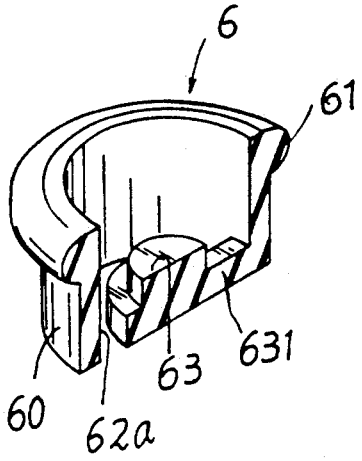
FIG. 11 is a partial perspective drawing of a resetting means of the present invention.

Another preferred embodiment of the resetting means 6 of the present invention is modified as shown in FIGS. 7–11, which includes: a cylindrical portion 60 slidably held on the grip 12 having suitable height without obstructing the grasping of the grip 12, a depression portion 61 generally formed as an annular ring slidably disposing around a straight portion 120 of the grip 12, a plunger 63 integrally secured with the depression portion 61 by a linking member 631 passing through a linking-member slot 126 longitudinally cut in the grip 12 with the plunger 63 operatively contacting a lower end portion 141 of the lower extending tube 14, an arcuate slot **62*a* generally circular shaped defined between the depression portion of annular ring shape and the plunger 63 to be slidably engageable with a cylindrical wall of the grip 12, and a restoring spring 64 retained between an upper shoulder portion 121*a* in the grip 12 and a peripheral portion of the plunger 63 for normally urging the plunger 63 and the resetting means 6 downwardly to be rested on a bottom portion 127 of the guiding-tube hole 123 of the grip 12, whereby upon a depression of the depression portion 61 upwardly, the plunger 63 will urge the lower extending tube 14 upwardly to compress and reset the umbrella-closing spring 4 as shown in the figures from FIG. 10 to FIG. 7**.

The resetting means 6 as shown in FIGS. 7–10 is movably operated in the grip 12 without protruding downwardly beyond the grip 12 as shown in FIGS. 1–4, which serves as another design and marketing choice of the present invention.

The operating procedures of the present invention are summarized as follows:

1. Opening the umbrella

Figure 2:
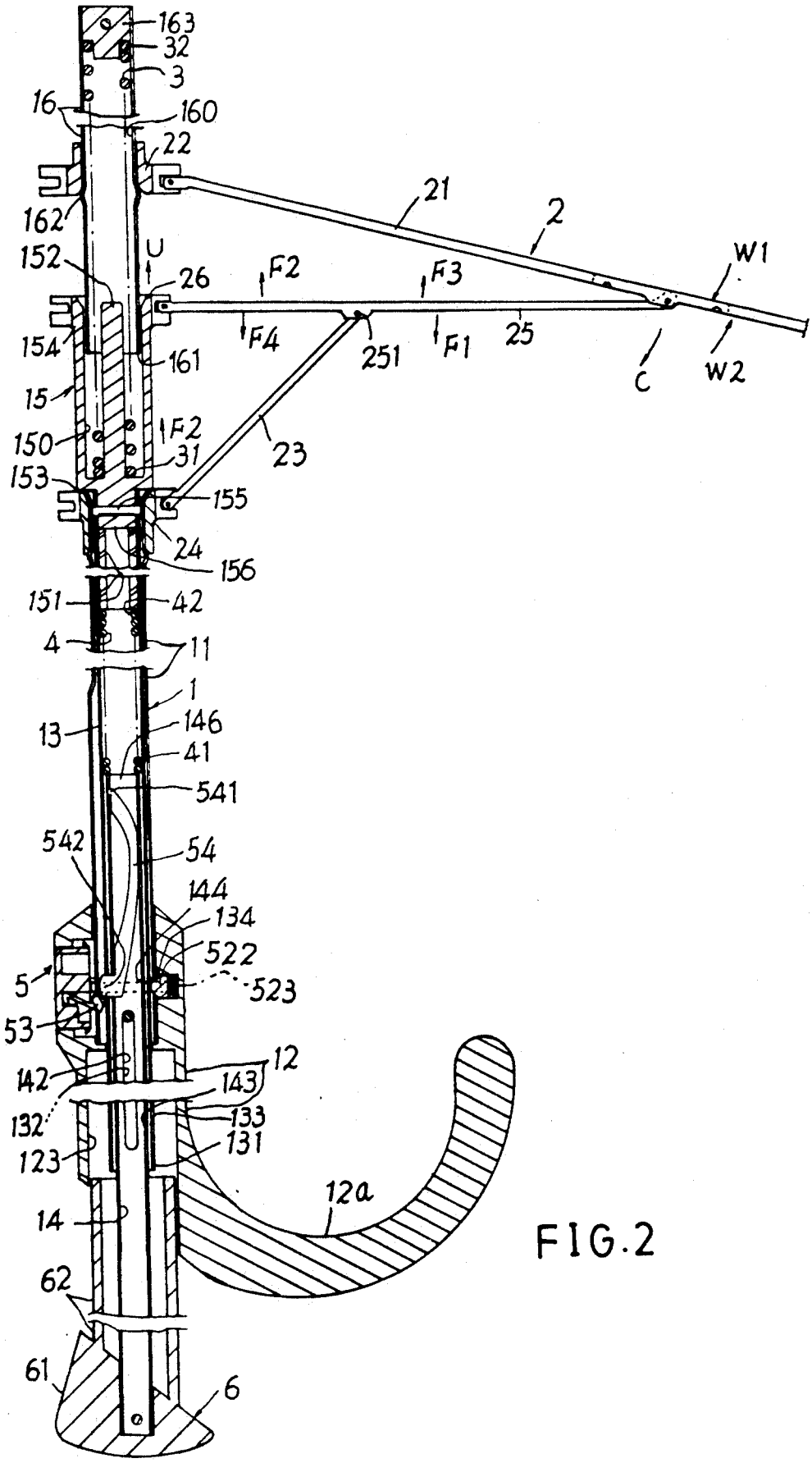
FIG. 2 shows an opened umbrella from FIG. 1 in accordance with the present invention.

The push button 51 is depressed to retract the wedge portion 522 to disengage from the engaging hole 133 of the inner tube 13 as shown in FIG. 1, and the umbrella-opening spring 3 which has been previously compressed for storing its elastic energy will urge the middle-notch bracket 15, the inner tube 13 and the lower extending tube 14 as coupled with the inner tube 13 by the protrusion 542 as well as the resetting means 6 downwardly (D) to be lowerly protruded beyond the grip 12 as shown in FIG. 2, and the rib means (25,23,21) will also be biased to extend the umbrella cloth (not shown), thereby opening the umbrella. Upon a lowering movement of the tubes 13, 14 and the protrusion 542, the pushing rod 53 of the push button 51 will be downwardly biased as shown in FIG. 2, thereby preventing a further depression of the protrusion 542 for the prevention of a false operation for continuing a closing of the umbrella.

2. Closing the umbrella

Figure 3:
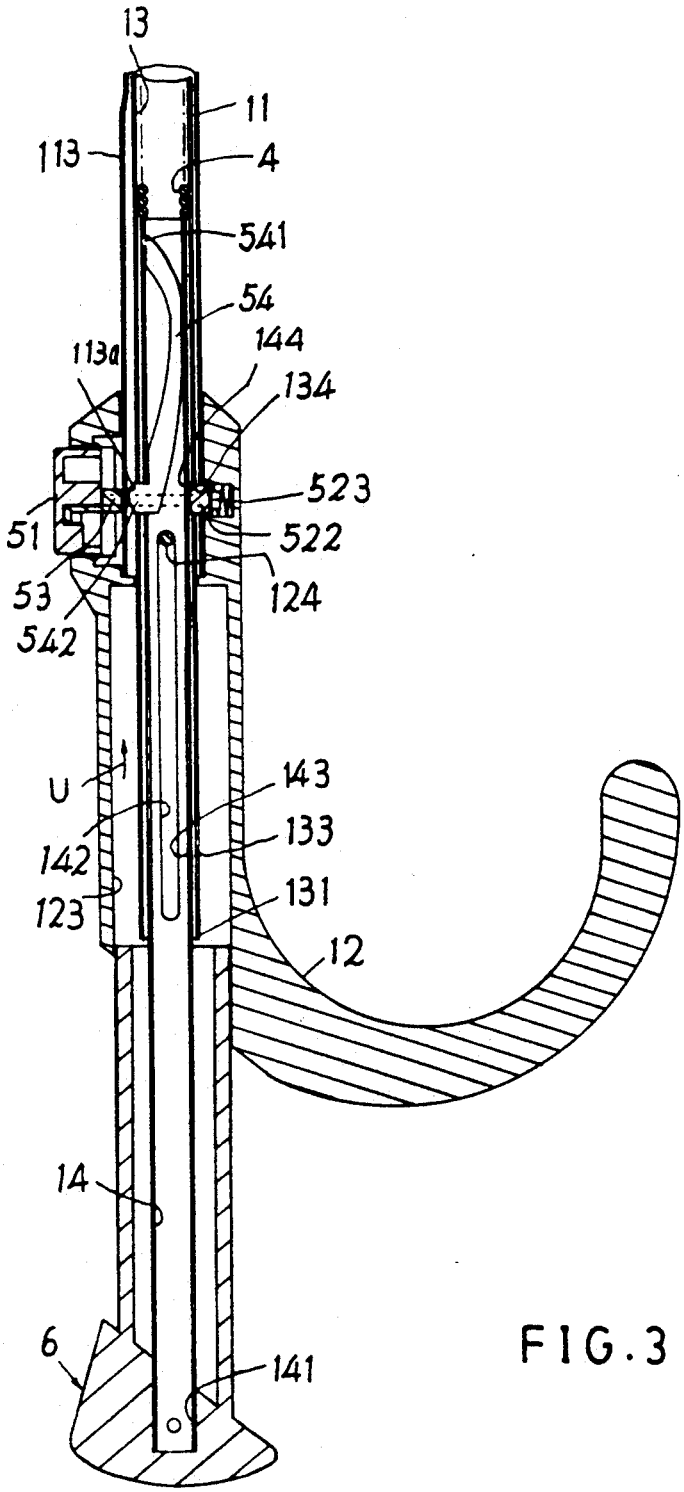
FIG. 3 shows a control means of the present invention ready for closing the umbrella from FIG. 2.
Figure 4:
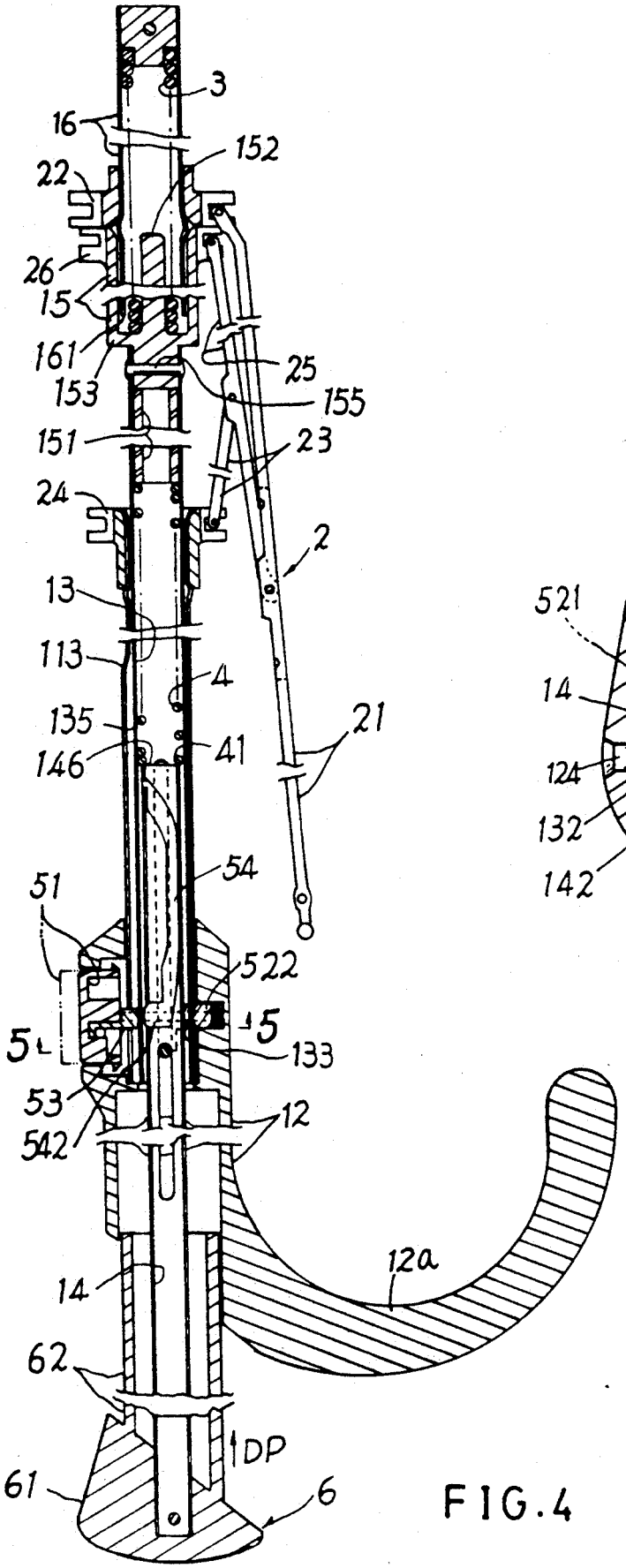
FIG. 4 shows a closed umbrella from FIGS. 2, 3.
Figure 5:
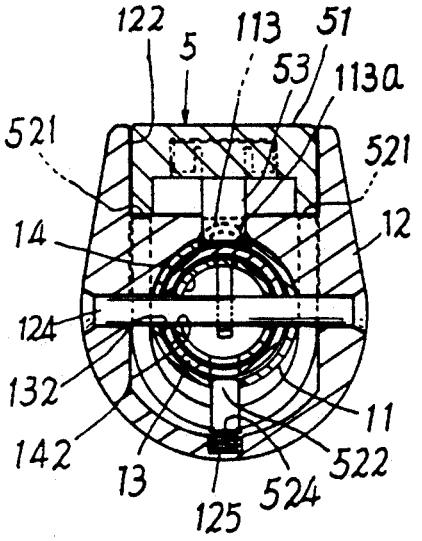
FIG. 5 is a cross-sectional drawing of the present invention when viewed from 5—5 direction of FIG. 4.
Figure 6:
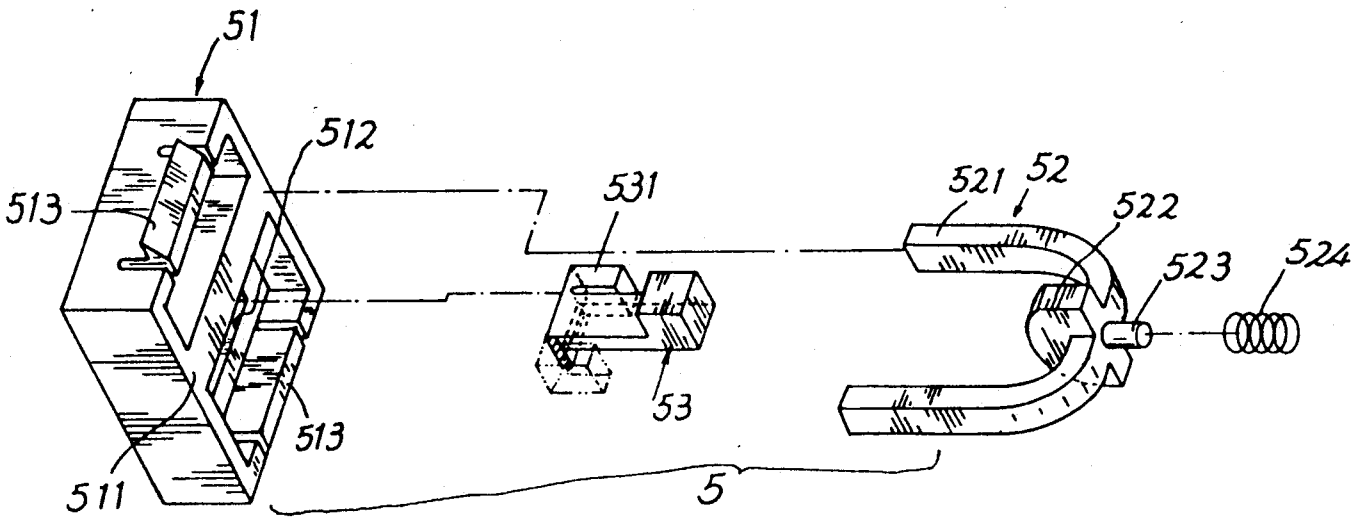
FIG. 6 is a persepctive view of the control means of the present invention.

When releasing the push button 51 as shown in FIG. 2, the latch 52 will restore the push button 51 and level the pushing rod 53 as shown in FIG. 3. From FIG. 1 to FIG. 2, the lower extending tube 14 and the inner tube 13 are lowered to retain an upper slot end of each elongate slot 142, 132 on the guiding pin 124. Upon a depression of the push button 51 as shown in FIG. 3 to retract the protrusion 542 to disengage the inner tube 13 from the lower extending tube 14, the umbrella-closing spring 4, which has been previously compressed for storing its elastic energy and retained against the pin 124, will urge the upper block 151 of the middle-notch bracket 15, the middle notch 26 and inner tube 13 upwardly (direction U of FIG. 2) for retracting the ribs 2 (direction C) for closing the umbrella as shown in FIG. 4. The inner tube 13 is upwardly moved to re-engage the lower engaging hole 133 with the wedge portion 522.

A total force released by the umbrella-closing spring 4 including the elastic force of the closing spring 4 itself and a tension force of an opened umbrella cloth as urged by the rib means 2 when opening the umbrella may be enough for closing the umbrella, and also for compressing the umbrella-opening spring 3 from FIGS. 2, 3 to FIG. 4. In designing the present invention, a moving stroke (from a compressed retracted state to an extended state) of the closing spring 4 is preferably larger than a moving stroke of the opening spring 3 for helping developing an enough spring force of the closing spring 4 since the closing spring 4 plays double roles both for closing the umbrella from FIGS. 2, 3 to FIG. 4 and also for compressing (resetting) the opening spring 3 for storing a spring energy of the opening spring 3 for umbrella opening purpose such as from FIG. 1 to FIG. 2.

3. Resetting operation

The depression portion 61 of the resetting means 6 is depressed in direction DP as shown in FIG. 4 to move the extending tube 14 upwardly to compress (reset) the closing spring 4 until the protrusion 542 engages the protrusion holes 135, 145 as shown in FIG. 1 to thereby couple the inner tube 14 and the lower extending tube 14. The guiding tube 62 of the resetting means 6 is retracted into the grip 12.

Due to the depression portion 61 of the resetting means 6 of the present invention, a depression force (DP) for resetting the closing spring 4 is acted linearly along a longitudinal axis of the central shaft means 1 for fully using the depression force for compressing the spring 4 without causing any waste fraction of depression force. Therefore, this invention provides a more ergonomic operation convenience for an automatic umbrella.

4. Wind resistant function

As shown in FIGS. 2, 3, an opened umbrella of the present invention can well resist a wind force acting thereupon. For instance, if a wind force W1 is acted downwardly on the umbrella cloth and ribs 2, a downward force Fl is produced on a right side of the fulcrum 251, while an upward force F2 will exert on a left side of the fulcrum 251 trying to raise the middle notch 26 and the inner tube 13. However, the inner tube 13 is locked by the wedge portion 522 engaged with the engaging hole 134 of the tube 13 so as to stably open the umbrella.

If a wind force W2 is acted upwardly, a right upward force F3 and a left downward force F4 will be produced about the fulcrum 251 of the connecting rib 25. The downward force F4 will pressurize the middle-notch bracket 15 downwardly. However, the shoulder portion 153 of the bracket 15 is retarded against the lower notch 24 which is already fixed on the upper end of the outer tube 11 so as to prevent a collapsing or folding movement of the ribs 2 by the force W2.

Therefore, the prevent invention may resist a strong wind force either upwardly or downwardly, to be superior to a conventional automatic umbrella.

I claim:

1. An automatic umbrella comprising:

a central shaft means having a grip formed on a lower portion thereof;

a rib means pivotally mounted on said shaft means for securing an umbrella cloth thereon;

an umbrella-opening spring resiliently retained in an upper portion in said central shaft means for operatively opening the umbrella;

an umbrella-closing spring resiliently retained in a lower portion in said central shaft means for operatively closing the umbrella and for resetting the umbrella-opening spring when closing the umbrella from an opened state of the umbrella for storing an elastic energy of the umbrella-opening spring ready for a next opening operation of the umbrella;

a control means for controlling an opening and a closing operation of the umbrella; and a resetting means slidably held in said grip of said central shaft means for resetting said umbrella-closing spring when the umbrella is closed from its opened state for storing an elastic energy of said umbrella-closing spring for a next closing operation of the umbrella;

said central shaft means including: an outer tube having a grip secured on a lower portion of the outer tube, an inner tube slidably held in the outer tube, a lower extending tube slidably held in the inner tube and in the grip, a middle-notch bracket secured on an upper end portion of the inner tube, and an upper sleeve resiliently held on the middle-notch bracket, said outer tube having a lower end portion insertably fixed in an upper hole of the grip, an engaging hole formed in the lower end portion of the outer tube disposed on a first side of the central shaft means about a longitudinal axis of the central shaft means, an elongate groove longitudinally formed in the outer tube disposed on a second side of the central shaft means opposite to said first side of said central shaft means having a rod hole formed in a lower end portion of the elongate groove, and an upper ring portion formed on an upper end portion of the outer tube for securing a lower notch of the rib means for pivotally securing a stretcher rib of the rib means, said grip having a push-button hole formed in an upper portion of the grip disposed on the second side of the central shaft means, a guiding-tube hole longitudinally formed in a lower central portion of the grip and communicating the upper hole of the grip, and a guiding pin laterally secured in an upper portion of the grip; and said inner tube having a pair of elongate slots symmetrically longitudinally formed in a lower end portion of the inner tube to be slidably engageable with the guiding pin which is slidably engageable with the lower extending tube, a lower engaging hole formed in a lower portion of the inner tube disposed on the first side of the central shaft means, an upper engaging hole formed in the inner tube projectively positioned above the lower engaging hole, a protrusion hole formed in an upper end portion of the inner tube disposed on the second side of the central shaft means, opposite to the upper engaging hole, and a fixing pin provided in the upper end portion of the inner tube for securing the middle-notch bracket which is secured with a middle notch for pivotally securing an intermediate connecting rib of the rib means with a middle portion of the intermediate connecting rib pivotally connecting the stretch rib by a central pin.

2. An automatic umbrella according to claim 1, wherein said lower extending tube operatively controlled by the control means has a pair of elongate slots longitudinally symmetrically formed in a middle portion of the extending tube to be slidably engageable with the guiding pin, a lower engaging hole formed in a lower end portion of the extending tube corresponding to the lower engaging hole of the inner tube, an upper engaging hole formed in the extending tube positioned above the lower engaging hole of the extending tube corresponding to the upper engaging hole of the inner tube, a protrusion hole formed in the extending tube opposite to the upper engaging hole of the extending tube to be corresponding to the protrusion hole of the inner tube, and an upper tube end of the extending tube retaining a lower spring end of the umbrella-closing spring, said lower end portion of said extending tube operatively acted by said resetting means.

3. An automatic umbrella according to claim 2, wherein said control means includes: a push button slidably held in the button hole of the grip having an inside button surface normally urged by a pair of bifurcated arm members of a locking latch slidably held in an upper portion of the grip, and a pushing rod resiliently secured in the push button; the locking latch having the pair of bifurcated arm members slidably disposing about the outer tube, an engaging wedge portion formed on an end portion of a latch stem resiliently retained in a spring hole formed in the grip on the first side of the central shaft means with the wedge portion secured with a converging end portion of the two bifurcate arm members adjacent to the latch stem, and a latch spring retained in the spring hole normally urging the bifurcated arm members and urging the wedge portion laterally towards the second side of the central shaft means for selectively engaging the wedge portion with the lower engaging hole of the inner tube when closing the umbrella and engaging the upper engaging hole of the inner tube when opening the umbrella; and a resilient coupler secured in the lower extending tube and having a lower protrusion respectively engageable with a protrusion hole formed in the extending tube and with a protrusion hole formed in the inner tube for coupling the lower extending tube and the inner tube for retaining the umbrella-closing spring when being compressed, the lower protrusion slidably held in the elongate groove of the outer tube; whereby upon a depression of the push button to disengage the wedge portion from the lower engaging hole of the inner tube, the umbrella-opening spring will urge the middle-notch bracket, the inner tube, the lower extending tube and the resetting means downwardly along the grip for opening the umbrella; and upon a further depression of the push button to depress the lower protrusion of the resilient coupler to disengage the lower extending tube from the inner tube, the umbrella-closing spring will urge the inner tube and the middle notch upwardly for closing the umbrella; and upon a depression of the resetting means upwardly along the grip, the umbrella-closing spring will be compressed for resetting its elastic energy.

4. An automatic umbrella according to claim 1, wherein said resetting means includes: a depression portion secured on a lower end portion of the lower extending tube and a guiding tube secured with the depression portion and disposed around the lower extending tube with a tubular hole in the guiding tube, the guiding tube being slidably engageable with a guiding-tube hole in the grip.

5. An automatic umbrella according to claim 1, wherein said resetting means includes: a cylindrical portion slidably held on the grip, a depression portion generally formed as an annular ring slidably disposing around a straight portion of the grip, a plunger integrally secured with the depression portion by a linking member passing through a linking-member slot longitudinally cut in the grip with the plunger operatively contacting a lower end portion of the lower extending tube, an arcuate slot generally circular shaped defined between the depression portion of annular ring shape and the plunger to be slidably engageable with a cylindrical wall of the grip, and a restoring spring retained between an upper shoulder portion in the grip and a peripheral portion of the plunger for normally urging the plunger and the resetting means downwardly to be restored on a bottom portion of the guiding-tube hole of the grip, whereby upon a depression of the depression portion upwardly, the plunger will urge the lower extending tube upwardly to compress the umbrella-closing spring.

6. An automatic umbrella according to claim 1, wherein said middle-notch bracket includes: a lower tube portion inserted in an upper end portion of the inner tube for retaining an upper spring end of the umbrella-closing umbrella, a central stem formed in a central hole in the bracket for retaining a lower spring end of the umbrella-opening spring, a plug portion secured with the upper end portion of the inner tube by a fixing pin, a shoulder portion formed in a middle portion of the bracket operatively retainable with the lower notch secured on the outer tube, and an upper bracket portion integrally secured with the middle notch, said central hole of said bracket slidably engageable with an upper sleeve of the central shaft means.

7. An automatic umbrella according to claim 6, wherein said upper sleeve includes: an upper sleeve hole formed in the sleeve, a lower sleeve portion slidably engageable with the central hole of the bracket and for limiting the umbrella-opening spring in cooperation with the stem of the bracket, an upper block fixed in a top portion of the sleeve for retaining an upper spring end of the opening spring, and a middle ring portion for securing an upper notch on the middle ring portion for pivotally securing a top rib of the rib means with the top rib pivotally securing an intermediate connecting rib of the rib means.

* * * * *